United States Patent [19]

Naik et al.

[11] Patent Number: 5,064,727

[45] Date of Patent: Nov. 12, 1991

[54] ABRADABLE HYBRID CERAMIC WALL STRUCTURES

[75] Inventors: Subhash K. Naik, Milford; William H. Doddman, Guilford, both of Conn.

[73] Assignee: Avco Corporation, Providence, R.I.

[21] Appl. No.: 467,723

[22] Filed: Jan. 19, 1990

[51] Int. Cl.[5] ..... F01D 11/08

[52] U.S. Cl. ..... 428/593; 428/621; 428/633; 428/937; 415/173.4

[58] Field of Search ..... 415/173.4, 174.4, 200; 428/593, 937, 632, 633, 613, 621, 623, 678

[56] References Cited

U.S. PATENT DOCUMENTS

| | | | |
|---|---|---|---|
| 3,042,365 | 7/1962 | Curtis et al. | 415/173.4 |
| 3,053,694 | 9/1962 | Daunt et al. | 415/173.4 |
| 3,807,993 | 4/1974 | Palai et al. | 148/428 |
| 3,844,011 | 10/1974 | Davies | 428/593 |
| 3,879,831 | 4/1975 | Rigney et al. | 415/173.4 |
| 3,975,165 | 8/1976 | Elbert et al. | 415/173.4 |
| 4,269,903 | 5/1981 | Clingman et al. | 415/173.4 |
| 4,280,975 | 7/1981 | Ammann | 428/593 |
| 4,289,447 | 9/1981 | Sterman et al. | 428/593 |
| 4,336,276 | 6/1982 | Bill et al. | 415/173.4 |
| 4,405,284 | 9/1983 | Albrecht et al. | 415/173.4 |
| 4,409,054 | 10/1983 | Ryan | 415/173.4 |
| 4,588,607 | 5/1986 | Matarese et al. | 415/173.4 |
| 4,594,053 | 6/1986 | Sohngen | 415/200 |
| 4,642,993 | 2/1987 | Sweet | 426/593 |
| 4,669,955 | 6/1987 | Pellow | 415/197 |
| 4,774,150 | 9/1988 | Amano et al. | 415/173.4 |
| 4,867,639 | 9/1989 | Strangman | 415/173.4 |

FOREIGN PATENT DOCUMENTS

| | | | |
|---|---|---|---|
| 3534641 | 4/1987 | Fed. Rep. of Germany | 415/174 |
| 2258524 | 9/1975 | France | 415/173.4 |

*Primary Examiner*—John J. Zimmerman
*Attorney, Agent, or Firm*—Perman & Green

[57] ABSTRACT

Abradable wall structures for high temperature applications, such as in turbine housings and the like. The wall structures comprise a superalloy metal base plate supporting a superalloy metallic cellular structure, the cells of which are filled to a substantial extent with at least one ceramic core material providing high heat resistance, oxygen barrier and low thermal expansion properties. The invention involves the application of a porous or pore-forming surface composition to provide a corrosion-resistant, erosion-resistant abradable outer surface layer, the softness or porosity of which can be tailored to improve the abradability of the wall structure, while imparting oxidation-, corrosion- and erosion-resistance to the structure. The surface layer composition may comprise metal superalloy, ceramic or cermet base compositions containing fugitive or retained inert filler materials.

14 Claims, 3 Drawing Sheets

FIG. 2A.
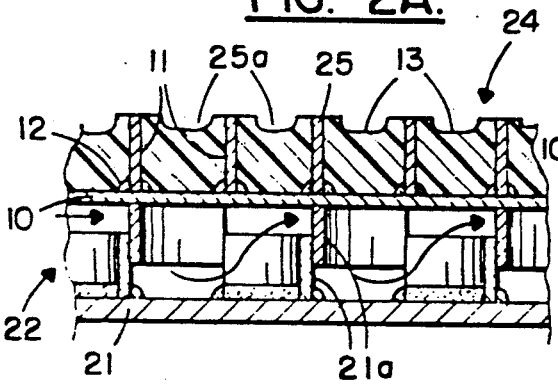
FIG. 2B.
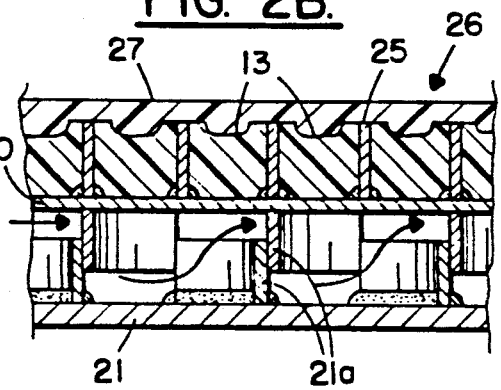
FIG. 3.
FIG. 3A.
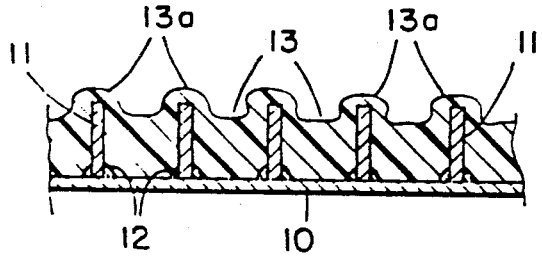
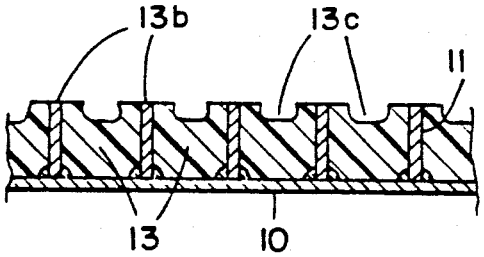
FIG. 3B.
FIG. 3C.
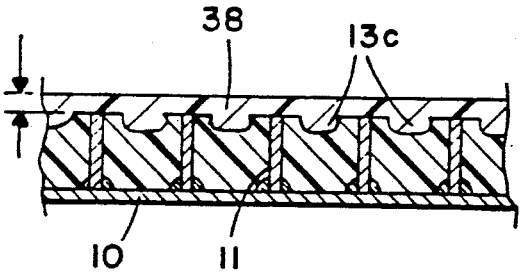
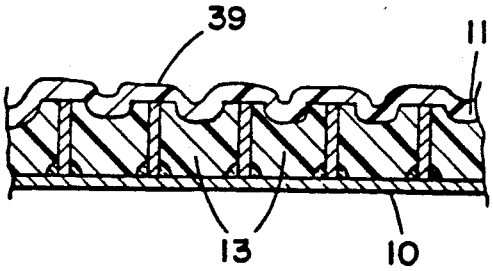

ABRADABLE HYBRID CERAMIC WALL STRUCTURES

BACKGROUND OF THE INVENTION

The present invention relates to stationary seal wall structures designed for use in high temperature applications such as jet turbine housings which provide a stationary seal around the rotating rotor blade tips or shroud to restrict the amount of intake air therebetween. In such applications it is important that the wall structure be as close as possible to the rotor blades or shroud since the gap increases during operation due to the increased thermal expansion of the wall structure relative to the turbine blade structure. An increased gap can result in an increase in fuel consumption and/or a decrease in engine power. Thus, the wall structure must be abradable to prevent damage upon possible contact with the rotating turbine blade structure during initial start-up and prior to thermal expansion. Also it is desirable to reduce thermal expansion of the wall structure, such as by cooling thereof, and to reduce the erosion and/or corrosion of the surface of the wall structure in the gap in order to prevent increases in the gap width due to loss of material from said surface during use.

DISCUSSION OF THE PRIOR ART

Reference is made to U.S. Pat. No. 4,594,053 (Sohngen) which discloses erosion-resistant abradable wall structures over which the present invention represents substantial improvements. The wall structures disclosed by Sohngen are similar to those of the present invention to the extent that they comprise a support wall, a honeycomb structure bonded thereto and a ceramic core layer applied to fill the honeycomb cells to impart heat resistance and corrosion resistance. However the Sohngen structures are restricted to the use of certain stabilized zirconium oxide cermet compositions since most other ceramic compositions are too hard and brittle for use in producing the abradable exposed surface of an erosion-resistant abradable wall structure.

The stabilized zirconium oxide cermet compositions of Sohngen include compatible metal oxides such as yttrium, magnesium and calcium oxides which form a non-porous homogeneous ceramic/metal composition of increased softness but reduced oxidation-barrier properties.

Zirconium oxide compositions and other known ceramic compositions have disadvantages in that they generally represent a compromise between greater softness, to provide good abradability but poor oxygen barrier properties (as is the case with stabilized zirconium oxide compositions), and greater hardness, to provide better oxygen barrier properties but resulting in brittleness and poor abradability. Thus, softer ceramic compositions generally provide insufficient oxidation resistance during use and harder ceramic compositions are brittle and have a low degree of abradability so that they can only be used in association with turbine blades or other abrasion-causing materials having certain predetermined degrees of hardness. Otherwise the turbine blade tips will be damaged and/or the ceramic or cermet layer will crack and break away from its honeycomb support.

Reference is also made to U.S. Pat. Nos. 3,975,165; 4,558,607 and 4,669,955 for their disclosures of similar abradable wall structures having exposed abradable ceramic layers.

SUMMARY OF THE INVENTION

The present invention relates to improved abradable hybrid stationary seal wall structures having a ceramic core which can incorporate ceramic compositions of all types, including those having superior heat resistance and possible poor abradability, and having a porous outer surface layer having excellent resistance to erosion, corrosion and oxidation, and which is tailored to provide different predetermined degrees of porosity and abradability to suit their use in association with different abrasion-causing materials such as turbine blades and shrouds of different compositions and different degrees of hardness. This permits the degree of abradability to be kept as low as possible, whereby the degree of resistance and/or insulation against erosion, corrosion and oxidation can be maintained as high as possible for each system during use.

According to the present invention the outer surface layer preferably is a M'CrAlY+X superalloy layer, but may also be a ceramic layer or a cermet (ceramic/metal) layer, each of said different types of layers being processed so as to have porosity and improved abradability without loss of the necessary erosion-, corrosion- and oxidation-resistance properties. In the case of M'CrAlY+X superalloy surface layers, M' is one or more metals selected from the group consisting of nickel, cobalt and iron, and X is one or more additives selected from the group consisting of hafnium, silicon, molybdenum, tungsten, tantalum and rhenium.

More specifically, the present invention relates to hybrid abradable cellular wall structures in which the cells are filled to a substantial degree, i.e., from 30% to 98%, preferably from about 80% to 90%, of their volume with one or more ceramic filler layer(s) to provide a ceramic core layer which is supercoated with an outer oxygen barrier layer having a minimum thickness between about 0.01 inch and 0.06 inch over said core layer, the degree of porosity of the outer layer being variable to vary the degree of hardness and abradability thereof to conform to the specific requirements of usage to which the wall structure is to be applied. The underlying ceramic core layer(s) impart high heat resistance, oxygen barrier, and low thermal expansion properties, and is protected against contact with the abrading elements, such as the tips of turbine blades. The porous outer surface layer imparts excellent resistance to erosion, corrosion and oxidation, and its degree of porosity can be increased as much as necessary for each particular use in order to provide the necessary degree of abradability while retaining the maximum possible resistance to erosion, corrosion and oxidation during such use.

BRIEF DESCRIPTION OF THE DRAWINGS

FIGS. 1 to 1D, FIGS. 2 to 2B, FIGS. 3 to 3C and FIGS. 4A to 4E are diagrammatic cross-sectional views illustrating the application of ceramic filler or core layers and superalloy outer layers to cellular wall structures according to various embodiments of the present invention.

DETAILED DESCRIPTION

Referring to the various figures of the drawings, the honeycomb wall structure of each comprises a housing or support wall 10, such as of temperature-resistant superalloy metal, a honeycomb-type superalloy metal structure comprising compartment walls 11, the base of at least some of said walls 11 being brazed at 12 to unite the honeycomb-type structure to the inner housing wall 10 to form a plurality of cells opening outwardly from the support or housing wall 10.

Figure 1:
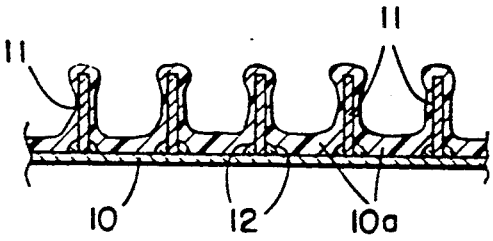

In FIG. 1, the honeycomb-type metal structure is a preferred structure having a thin conventional M'CrAlY superalloy bonding layer 10*a*, between about 1 and 6 mils thick, sprayed over the housing wall 10 and compartment walls 11 to improve the adhesion of the after-applied ceramic layer(s) 13 thereto, as disclosed for example, in U.S. Pat. No. 4,594,053 (Sohngen). M' being one or more metals from the group consisting of nickel, cobalt and iron.

Figure 1A:
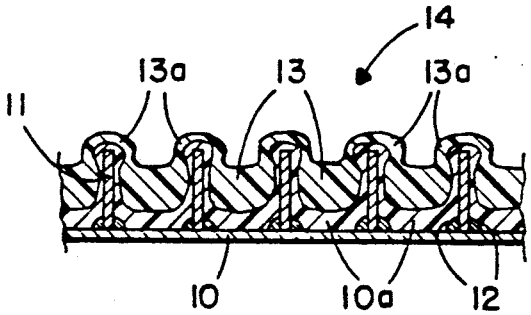

Referring to FIG. 1A, the honeycomb wall structure thereof is illustrated after the spraying of one or more applications of a ceramic composition over and into the honeycomb-type structure to form ceramic core layer(s) 13 over the bonding layer 10*a*, which nearly fills the compartments or cells between the walls 11 and extends up over the outer tips of the walls 11 as ceramic coating areas 13*a*, to form an intermediate structure 14.

The application of the ceramic core layer(s) 13 preferably is such as to fill the honeycomb cells to an extent of between about 80% and 90%, since the application of excessive amounts of ceramic composition results in a brittle structure, particularly in the areas 13*a* overlying the upper edges of the partition walls 11. Therefore the application of the ceramic core layer(s) is such as to form a thin layer in areas 13*a*, over the tips of the walls 11, and cell fillings 13, the upper surface of which is recessed therebelow, to produce an uneven upper ceramic surface which has better bonding properties for the after-applied porous supercoating such as M'CrAlY+X or a ceramic composition (including ceramic/metal or cermet compositions).

Figure 1B:
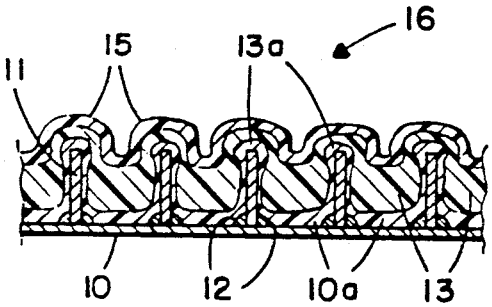

According to one embodiment, the intermediate structure 14 is completed, as shown in FIG. 1B, by the application of a thin outer surface layer 15 such as of M'CrAlY+X superalloy composition over the ceramic core layer(s) 13, layer 15 being porous or being treated after application to become porous, to form the final walled structure 16 having an irregular superalloy outer surface corresponding to the irregular outer surface of layer(s) 13, including areas 13*a*. The compartment or cell walls 11 are encased within the ceramic layer(s) 13.

Figure 1C:
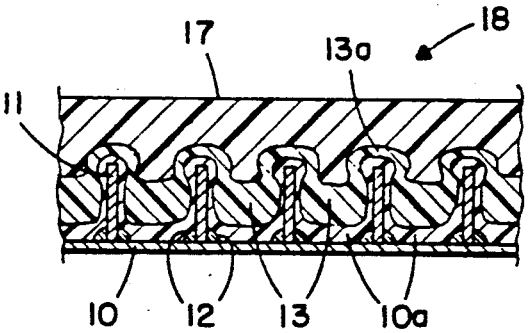

FIG. 1C illustrates another embodiment in which the coating, such as of M'CrAlY+X superalloy, is applied to structure 14 as a thick layer 17 which fills the surface voids between the outermost ceramic core layer portions 13*a* and extends thereabove, such as by a distance between about 0.01 to 0.06 inch, to form a final structure, or by a distance greater than about 0.06 inch, to form an intermediate structure 18.

Figure 1D:
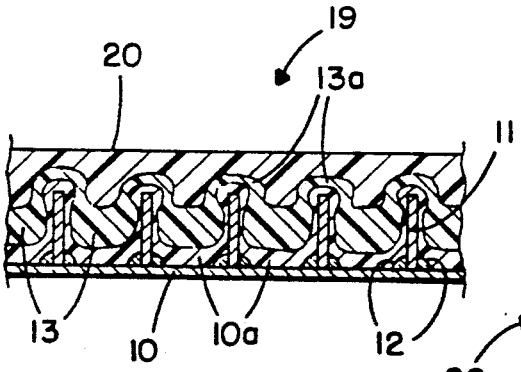

The intermediate structure 18 of FIG. 1C is completed by grinding down the thick superalloy layer 17 to a desired minimum thickness, such as between about 0.01 to 0.06 inch above the ceramic areas 13*a*, to form a completed wall structure 19 having a superalloy outer surface layer 20 of the desired thickness having a smooth outer surface, as illustrated by FIG. 1D.

Figure 2:
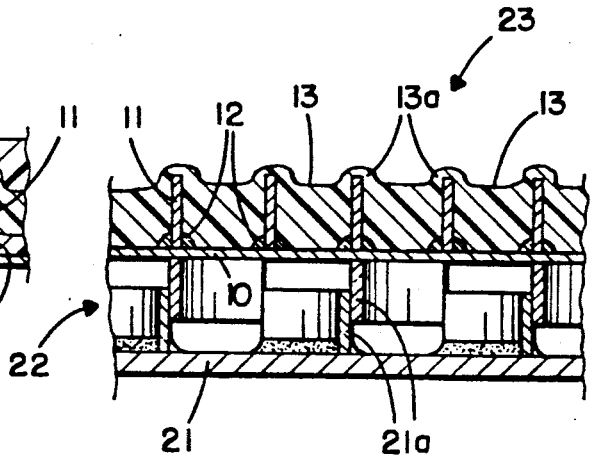

FIG. 2 of the drawing is similar to FIG. 1A except that the housing wall 10 comprises the outer wall of a honeycomb cooling structure of the type illustrated by U.S. Pat. No. 4,642,993 (Sweet), the disclosure of which is hereby incorporated herein by reference. The honeycomb cooling structure 22 comprises an interior wall 21 beneath the inner wall 10, and an interior honeycomb compartment structure brazed or welded to wall 21 or to both walls 21 and 10, comprising a plurality of partition walls 21*a* forming interconnected cells each of which is open at the top to an adjacent cell and open at the bottom to a different adjacent cell to permit cooling fluid such as air to flow through the structure 22 and to cause the cooling fluid to be directed against both walls 21 and 10 for the cooling thereof, as illustrated.

The intermediate structure 23 of FIG. 2 comprises the ceramic filler core layer(s) 13 applied over the wall 10 of the outer honeycomb-type metal structure, extending down and, in the illustrated embodiments, nearly completely filling the cells between the partition walls 11 thereof and up thereover to form ceramic layer(s) portions 13*a*. A bonding under layer 10*a* of M'CrAlY may be present, as illustrated by FIG. 1.

The intermediate structure 23 of FIG. 2 is then ground down to the level of the tips of the compartment or cell walls as illustrated by FIG. 2A, to remove the ceramic coating areas 13*a* and form a ground ceramic layer 25 having shallow surface voids 25*a* in the second intermediate structure 24. The final walled structure 26 is produced, as illustrated by FIG. 2B, by applying an outer surface layer 27, such as of M'CrAlY+X superalloy, over the ground ceramic layer 25 and tips of partitions 11 in a desired thickness, or in a greater thickness which is thereafter ground to a desired thickness, such as between 0.01 and 0.06 inch over the ground ceramic layer 25.

FIG. 3 of the drawings illustrates another embodiment of the invention which uses an intermediate ceramic-coated honeycomb structure, similar to intermediate structure 14 of FIG. 1A except that the optional bonding layer 10*a* is not shown, and similar to intermediate structure 23 of FIG. 2 except that the optional underlying honeycomb cooling structure is not shown.

In the embodiment of FIG. 3, the ceramic-coated structure is ground down to the upper surfaces of the partitions 11, as shown in FIG. 3A, to remove the ceramic areas 13*a* and produce an uneven ceramic surface having smooth areas 13*b*, including the exposed tips of the partitions 11, and recessed surface areas 13*c* therebetween.

According to the embodiment of FIG. 3B, the ceramic-coated, ground structure illustrated by FIG. 3A is coated with a porous surface layer such as a M'CrAlY+X superalloy layer 38 which fills the recessed areas 13*c* between the partitions 11 and forms a surface layer 38 which has or is ground to have a smooth upper surface and a desired thickness, such as between about 0.01 and 0.06 inch above the tips of the partitions 11, as illustrated by FIG. 3B.

Alternatively, the intermediate ceramic-coated structure of FIG. 3A can be coated with a uniformly thin porous surface layer 39, such as of the M'CrAlY+X superalloy composition, having a uniform desired thickness, such as between about 0.01 and 0.06 inch, as illustrated by FIG. 3C. The upper surface of the surface layer 39 is uneven, since it conforms to the underlying uneven surface of the ceramic layer 13, but no grinding is necessary to obtain the desired thickness in areas overlying the ceramic layer 13 and the tips of the partitions 11.

Figure 4A:
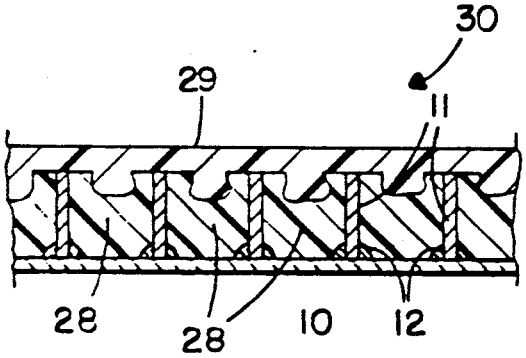

In the embodiment of FIG. 4A the walled honeycomb structure is sprayed with two different graded ceramic core compositions, one of which is applied and ground down to the tips of the partition walls 11, to form a base ceramic core layer 28 which nearly fills the compartments or voids between the honeycomb walls 11, similar to the illustration of FIG. 3A, and the other of which is applied thereover to form a top ceramic core layer 29 of composition having better bonding properties for the porous outer layer to be applied thereover, to form the intermediate structure 30 of FIG. 4A.

Figure 4B:
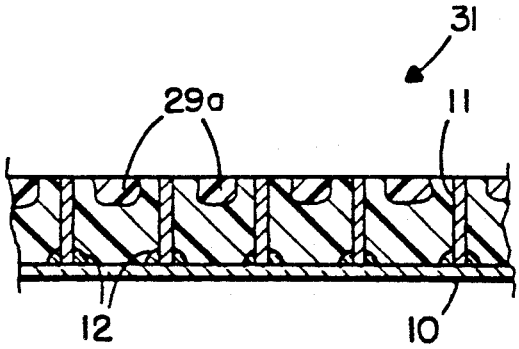

In the next step, illustrated by FIG. 4B, the top ceramic core layer 29 is also ground down to the level of the tips of the compartment partition walls 11. This leaves top ceramic core layer portions 29*a* forming a smooth outer layer in association with the tips of the partition walls 11, to produce a second intermediate structure 31.

Figure 4C:
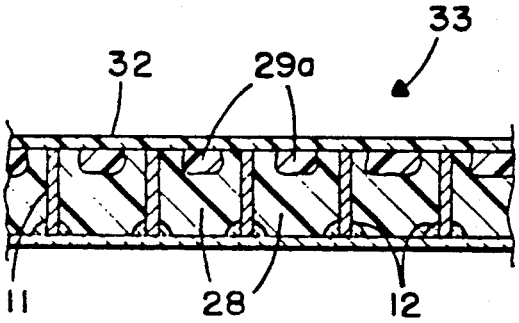

FIG. 4C illustrates the application of a 0.01 to 0.06 inch thick porous outer surface layer 32 such as of M'CrAlY+X over the ground surface areas of the base ceramic layer 28 and the outer ceramic core layer portions 29*a* and the tips of the partition walls 11 to produce the final walled structure 33.

Figure 4D:
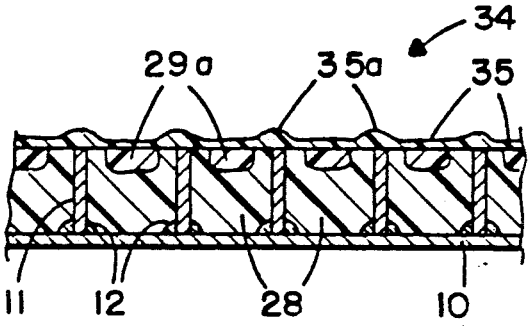
Figure 4E:
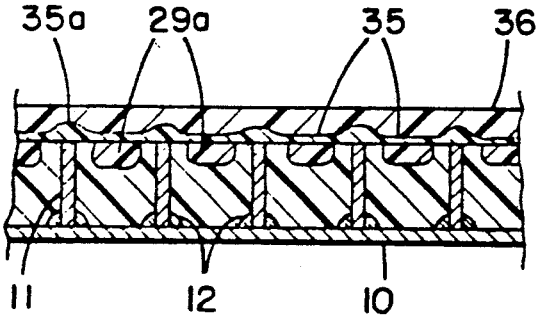

FIG. 4D and 4E illustrate a variation of the embodiment of FIGS. 4B and 4C. Thus in FIG. 4D the intermediate structure 31 of FIG. 4B is resprayed with the second ceramic composition to deposit a top ceramic core coating 35 including portions 35*a* over the tips of the compartment walls 11 to produce an intermediate structure 34 having a continuous irregular surface layer 35 of the second ceramic composition having good bonding properties for the porous outer layer such as a superalloy layer to be applied thereover.

The final walled structure 37 is produced, as illustrated by FIG. 4E, by applying an outer porous surface layer 36, such as, of M'CrAlY+X superalloy, over the ceramic layer 35 including portions 35*a*, and thereafter grinding to the desired thickness. As will be evident to those skilled in the art the present invention enables the use of a variety of different ceramic compositions, alone or in combination, to produce walled structures having excellent heat-resistance, and to select or mix ceramic compositions so as to provide excellent bonding for an outer abradable porous layer which is formulated to provide the maximum possible degree of resistance to erosion, corrosion and oxidation, such as a porous M'CrAlY+X layer, a porous ceramic layer or a porous cermet layer.

The minimum thickness of the abradable porous surface layer over the ceramic layer, as in FIGS. 1B and 1D, or over the tips of the partition or cell walls 11, as in FIGS. 2B, 3B and 3C, is between about 0.01 and 0.06 inch. Such thickness provides resistance to erosion, oxidation and corrosion even after the usual degree of abrasion - loss occurs.

The following example illustrates methods and materials for the production of novel abradable hybrid ceramic seal wall structures according to a preferred embodiment of the present invention. The main purpose is to develop high temperature seals for turbine cylinder applications which are capable of operating at super high surface temperatures up to and/or greater than from about 2500° F. to about 3000° F. In order to help prevent oxidation of the underlying superalloy metal honeycomb structure, and the M'CrAlY bonding materials, at such high temperatures, it is preferred to provide a means for cooling the support wall 10, such as by use of an underlying heat transfer honeycomb matrix, such as the matrix 22 of FIG. 2 as disclosed by aforementioned U.S. Pat. No. 4,642,993 (Sweet). Such matrix 22, including the support wall 10 and the outer partition or cell walls 11, consists of superalloy metals such as Hastelloy X, disclosed for example in U.S. Pat. No. 4,478,638 (Smith) or other similar temperature-resistant, erosion-resistant superalloy metal compositions such as C101, disclosed in U.S. Pat. No. 3,807,993 (Dalai) or Cabot 214.

For example, a honeycomb matrix as illustrated in FIG. 2 is prepared comprising a C101 substrate wall 21, a support wall 10, matrix partition walls 21*a* therebetween and outer partition or cell walls 11, walls 11 and 21*a* being of Hastelloy superalloy about 3 mils in thickness, brazed to said substrate wall 21 and to both surfaces of said support wall 10 to form inner and outer honeycomb cells about ⅛ inch in height and width.

The outer honeycomb structure, comprising the upper surface of support wall 10 and the partition cell walls 11, is vapor degreased and grit blasted in conventional manner to render it more receptive to the compositions to be applied thereto.

In order to improve the oxidation resistance of the seal structure at superhigh temperatures it is preferred to apply a superalloy bonding layer thereto, such as layer 10*a* of FIG. 1. Thus a thin layer, between about 2 and 6 mils in thickness, of a superalloy bonding layer composition comprising M'CrAlY (22 Cr, 10 Al, 1 Y, balance Ni) is plasma sprayed thereover to form a thin bonding layer 10*a* which preferably covers the upper surface of the support wall 10 and the surfaces of the partition walls 11. The bonding layer 10*a* functions to assist the bonding of the ceramic core composition to the seal structure and to increase the oxidation resistance of the seal structure at superhigh temperatures.

Next the ceramic core layer(s) 13 is plasma sprayed into the upper honeycomb, over the bonding layer 10*a*. Preferably this is done in three separate steps, each of which deposits a ⅓ thickness of the ceramic layer 13 comprising zirconium/yttrium oxides ($ZrO_2$ $8Y20_3$) to form a graded core layer 13.

After each ceramic coating step the honeycomb structure is ground down to the top surface of the partition walls 11 in order to remove the ceramic composition therefrom and expose the metallic top surfaces of the walls 11.

The final, third ceramic coating step substantially fills the honeycomb cells, leaving central surface voids 25*a* extending about 10 mils down below the top surfaces of the walls 11, as illustrated by FIG. 2A.

Finally the ceramic-coated seal structure 24 is top coated by plasma spraying thereover a thick layer , i.e., about 50 mils, of a M'CrAlY+X superalloy composition such as NiCrCoAlMo/WTaReYHfSi (22 Cr, 12 Co, 10 Al, 3 Mo/W, 2 Ta, 2 Re, 1 Y, 1 Hf, 0.5 Si, balance Ni) containing about 10% by weight of $Al_2O_3$ filler powder, after which the abradable porous top layer is ground down to a desired thickness above the top surfaces of the partitions 11, such as about 0.02 inch, as illustrated by top layer 27 of FIG. 2B. The improved or increased abradability of the erosion-resistant, corrosion-resistant outer surface layer 27 is provided by rendering such layer porous by the inclusion of fugitive or removable inert filler materials, or by the inclusion of inert, friable or erodable filler materials, such materials being finely divided and uniformly dispersed throughout the surface layer so as to form a microporous structure in which the pores are empty, due to the inert material such as resinous material, being removed therefrom by baking or other extraction means, or in which the pores are filled with heat-resistant erodable filler material, such as ceramic spheres or metal oxides or carbides, which are hard and impart friability to the surface layer compositions in which they are contained. Such pores, whether empty or filled, render the surface layer microporous and softer or more abradable than similar non-porous surface layers, and much softer or more abradable than the turbine blade tips or blade shrouds which may come into contact therewith, thereby protecting the blade tips and shrouds against damage.

In the case of the preferred M'CrAlY+X superalloy-base surface layer compositions, porosity is preferably obtained by the inclusion of temperature resistant erodable fillers which remain in place in the final porous surface layer. Suitable inert fillers include hollow ceramic spheres such as $ZrO_2 \cdot 8YO_3$, certain metal oxides, carbides and oxycarbides such as $Al_2O_3$, SiC, alumina-coated carbides, TiC, nitrides such as BN and similar other materials the selection of which will be apparent to those skilled in the art. Similar fillers may be added to ceramic or cermet compositions to increase their abradability while reducing their brittleness.

In the case of ceramic- or cermet-base material compositions, porosity preferably is obtained by including fugitive or removable inert particulate filler materials which are burned off at elevated temperatures to leave a microporous ceramic or cermet structure which is more abradable and less brittle than similar non-porous structures. Suitable removable fillers include resinous materials such as Teflon, polyimides, polyamides, polyesters and similar materials which are inert to the ceramic or cermet composition and which burn away at elevated temperatures at which the ceramic or cermet surface layers are resistant to leave empty pores in the base material.

The amounts of such fillers incorporated into the surface layer compositions will be sufficient to produce at least small increases in the apparent softness and abradability of the surface layer, which increases with increasing amounts of the filler. Any retained filler should be one which is not reactive with contacting tips of the turbine blades or the outer surface of the blade shroud. Generally filler contents between about 5% and 40% by weight are satisfactory.

It is to be understood that the above described embodiments of the invention are illustrative only and that modifications throughout may occur to those skilled in the art. Accordingly, this invention is not to be regarded as limited to the embodiments disclosed herein but is to be limited as defined by the appended claims.

We claim:

1. Heat resistant abradable wall structure having high resistance to erosion, corrosion and oxidation, comprising a support wall having thereon a cellular element comprising partition cell walls forming a multiplicity of cells opening outwardly from said support wall, said support wall and cellular element comprising metal superalloys, a heat-resistant, oxygen barrier, ceramic core layer comprising at least one heat-resistant oxygen barrier, ceramic composition which fills each of said cells to an extent of between about 80% and 90% of their volume and which tapers up to at least the level of the upper edges of said partition cell walls, to provide a ceramic core layer having an uneven outer surface having areas recessed within each of said cells, and an abradable, porous, heat-resistant surface layer which fills the remaining portion of each of said cells and covers said heat resistant layer and said cellular structure, said abradable layer comprising a porous superalloy layer of M'CrAlY in which M' is one or more metals selected from the group consisting of nickel, cobalt and iron, and having a thickness, in areas overlying the upper edges of said partition cell walls, of between about 0.01 and 0.06 inch, said abradable layer rendering said cellular structure resistant to erosion, corrosion and oxidation.

2. Wall structure according to claim 1 in which said porous heat-resistant surface layer comprises a porous superalloy layer of M'CrAlY+X in which M' is one or more metals selected form the group consisting of nickel, cobalt and iron, and X is one or more additives selected from the group consisting of hafnium, silicon, molybdenum, tungsten, tantalum and rhenium.

3. Wall structure according to claim 1 in which said porous heat-resistant surface layer comprises a microporous network of hard, heat-resistant superalloy containing within the pores thereof an inert heat-resistant filler material which is softer than said base material.

4. Wall structure according to claim 1 in which said porous, heat-resistant surface layer comprises a microporous network of hard, heat-resistant superalloy containing empty pores which render said surface layer more abradable.

5. Wall structure according to claim 1 in which the underside of said support wall comprises cooling means for cooling the surface of said wall opposite to the surface having the cellular element thereon.

6. Wall structure according to claim 5 in which said cooling means comprises a heat-transfer cellular superalloy structure comprising interconnected open cells which direct cooling fluid such as air passed therethrough against the underside of said support wall to cool said support wall.

7. Wall structure according to claim 5 in which said cellular element and the surface of the support wall having the cellular element thereon carry a thin bonding layer of M'CrAlY superalloy, M' being at least one metal selected from the group consisting of nickel, cobalt and iron.

8. Wall structure according to claim 1 in which said cellular element and the surface of the support wall having the cellular element thereon carry a thin bonding layer of M' CrAlY superalloy, M' being at least one metal selected from the group consisting of nickel, cobalt and iron.

9. Wall structure according to claim 1 in which said heat-resistant ceramic core layer has an uneven surface and extends over and covers the upper edges of said partition cell walls.

10. Wall structure according to claim 9 in which said abradable surface layer has an uneven outer surface, corresponding to the uneven surface of said ceramic layer.

11. Wall structure according to claim 10 in which the minimum thickness of said abradable surface layer, over said ceramic core layer, is about 0.01 inch.

12. Wall structure according to claim 1 in which said heat-resistant ceramic core layer has an uneven surface and which tapers up to the upper edges of said partition cell walls but does not cover said upper edges.

13. Wall structure according to claim 1 in which said ceramic core layer has been ground down to the upper edges of said partition cell walls.

14. Wall structure according to claim 1 in which said abradable surface layer has been ground down so as to have a smooth outer surface.

* * * * *